United States Patent [19]

Florian

[11] 3,997,101

[45] Dec. 14, 1976

[54] MEAT TRAY OR THE LIKE

[75] Inventor: John Florian, Bakersfield, Calif.

[73] Assignee: Mobil Oil Corporation, New York, N.Y.

[22] Filed: Apr. 21, 1975

[21] Appl. No.: 569,917

[52] U.S. Cl. ..... 229/2.5 R; 229/30; 229/DIG. 11; 206/519

[51] Int. Cl.[2] ..... B65D 85/62; B65D 5/20

[58] Field of Search ..... 229/2.5, 30, DIG. 11; 206/518–520

[56] References Cited

UNITED STATES PATENTS

| | | | |
|---|---|---|---|
| 1,938,909 | 12/1933 | Huff | 229/2.5 |
| 2,041,537 | 5/1936 | Frost | 229/2.5 |
| 2,053,949 | 9/1936 | Emery | 229/2.5 |
| 2,766,919 | 10/1956 | Randall | 229/2.5 |
| 3,220,631 | 11/1965 | Reifers | 229/2.5 |
| 3,684,633 | 8/1972 | Haase | 229/2.5 |
| 3,718,274 | 2/1973 | Reifers et al. | 229/2.5 |

*Primary Examiner*—George E. Lowrance
*Assistant Examiner*—Douglas B. Farrow
*Attorney, Agent, or Firm*—Charles A. Huggett; James D. Tierney

[57] ABSTRACT

Stability of a thermoformed foam meat tray, especially to overwrapping by machine, is enhanced by a circumferential flange of the side walls of generally V-shaped cross section to terminate at approximately the plane of the bottom of the tray. Full nestability is afforded by upper surfaces of the flange at an angle to each other smaller than the corresponding angle between lower surfaces of the flange.

2 Claims, 3 Drawing Figures

FIG. 1
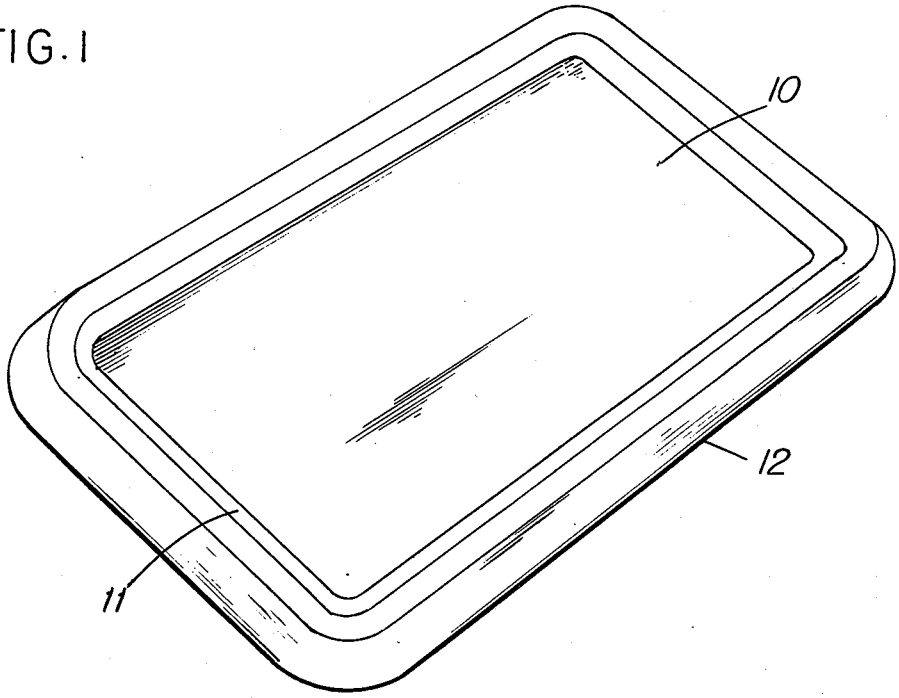
FIG. 2
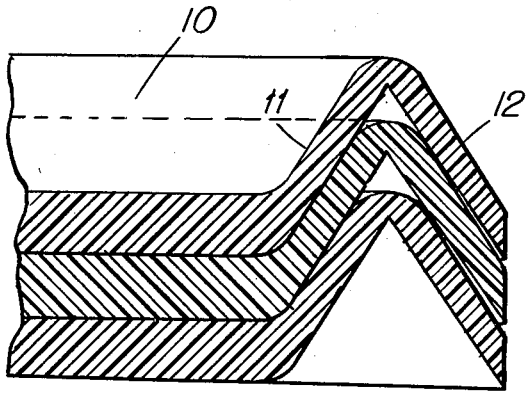
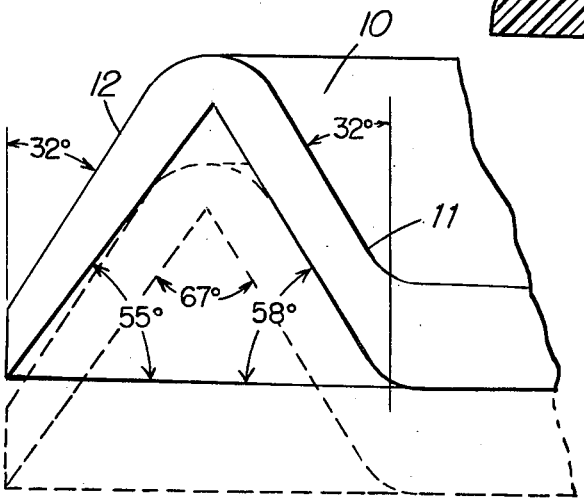
FIG. 3

MEAT TRAY OR THE LIKE

BACKGROUND OF THE INVENTION

The invention relates to trays for packaging meat, produce and the like. Typically, the product is supported on the tray and the whole is enclosed as by wrapping in a transparent plastic film. In order that the overwrap shall be closely applied for conservation of space, for maximum exclusion of air and other purposes, the preferred wrap is shrink film which contacts on heating to a suitable temperature or stretch film which is stressed during application and contracts after application by reason of its elasticity.

Trays presently in common use for the purposes started are constituted by a flat bottom, usually rectangular in outline, surrounded by side walls which typically flare upwardly and outwardly. To a considerable extent, the outward flare of the side walls is dictated by manufacturing, transportation and storage considerations. Because the trays are intended for discard after a single use, they must be of low cost, a criterion satisfied by high-speed molding on automatic machinery. Plastic foams and clear plastic sheet are thermoformed to the desired shape by heating a web of the plastic to a temperature suitable for draw molding and impressing the heated plastic between cooperating dies which draw the plastic to the form determined by the space between the dies. Like forms of pulp are prepared by feeding a slurry of cellulose fibers to a screen of the shape desired and drawing suction on the side of the screen opposite the slurry feed to felt the fibers on the screen and dewater the product. Upon drying, this technique results in a tray of which one side bears imprint of the screen and the other is a rough surface characteristic of random fiber deposition.

Each of these methods of forming by automatic machinery forbids undercuts or reentry surfaces which inhibit rapid release from the forming equipment. Indeed, surfaces normal to the bottom of the tray are avoided because the frictional drag on disengagement from forming surfaces can seriously impede smooth operation and promote jamming of the equipment due to improper orientation of articles which release from molds more easily at one portion than at other portions of the article.

Further constraints to similar effect are imposed by mandates of transport, storage and use. The trays for merchandizing of meat, produce and other products are of relatively low density, i.e. weight per unit of volume. Costs for transport and storage are therefore based primarily on the space occupied by a quantity of the articles. Volume occupied by a quantity of trays is reduced to the extent the articles nest, one within the next in a stack, with minimum space between them. That desirable result is served by outward flaring of side walls.

For ease of molding and to facilitate nesting, sharp angle corners are to be avoided, thus sacrificing the strengths inherent in webs which meet at well defined angles. Since the materials of construction are of relatively low rigidity and compressive strength, it becomes desirable to add structural strength by such devices as a flange extending outwardly of the top edge of the side wall.

All such expedients suffer the disadvantage that misalignment of the trim tool which removes excess material from margins to prepare the finished article can cause one or more edges to be unduly weakened. Such misalignments are not unusual in commercial operation and frequently result in inferior products, at times so serious as to require condenmation of finished product to scrap for reworking.

Inferior products from slight misalignment of trim tools aggravate a problem in packing of food products which is encountered even with perfectly formed and trimmed trays. These can be loaded and wrapped by hand operators without excessive difficulty, if the operator is attentive, but a different situation arises where, e.g. California, meat cuts and the like are packed in trays and wrapped by machine at a central butcher warehouse for delivery to and sale from marketing outlets remote from the point of packing. The packing machines in such installations include a ram which projects the loaded tray at high speed and positive thrust against a web of shrink film or stretch film, draws the film under the tray and seals it, followed by radiant heating in the case of shrink film. Depending on the angle at which the web of film encounters the edge of the tray wall, the latter may be bent downward, bent inward, or subjected to a compressive strain; resulting in unsightly distortion of the tray or actual fracture of the side wall with consequent risk of seepage of meat juices or the like into the wrapping under the package. As noted above, these problems are severely aggravated when misalignment of the trim tool causes production of packaging trays which vary, even slightly, from the design for which the central butchery operation has caused its packaging machines to be set.

SUMMARY OF THE INVENTION

The disadvantages and problems heretofore encountered are avoided by forming a plastic food tray characterized by a conventional rectangular bottom wall and outwardly flared side walls integral with the bottom and with each other; but modified from prior practice by a flange extending outwardly and downwardly from the top edges of the side walls to a plane substantially that of the tray bottom. The resultant circumferential member having the form, in cross-section of an inverted V is preferably formed of greater thickness at the apex and tapers to lesser thickness downwardly from the apex along at least one of the legs of the V. For example, the outward leg may be tapered to the end where it terminates at its outward edge of the tray.

Trays so formed are remarkably tolerant of trim tool misalignment which severely reduces length of the outer leg of the inverted V-shaped member at one side, since there remains an adequate portion of that leg to absorb strains applied by wrapping in shrink film or stretch film by flexing of the outer leg without compressive force of destructive intensity against the inner leg of the inverted V, thus preserving integrity of the tray.

Because of greater thickness at the apex of the inverted V, the angle between inner surfaces of the circumferential member is greater than the angle between the outer surfaces, thus promoting nestability of a stack of the trays. Economies in storage and transporation are thus realized and denesting of trays from the stack on automatic packaging machinery is promoted.

DESCRIPTION OF DRAWINGS

These and other objects and advantages are realized in a specific embodiment of the invention shown in the annexed drawings, wherein:

FIG. 1 is a perspective view of a food tray embodying the principles of the invention;

FIG. 2 is a partial section through a stack of three trays illustrative of the manner in which these trays nest; and FIG. 3 is an enlarged diagrammatic representation with typical angular relationships indicated thereon.

DESCRIPTION OF SPECIFIC EMBODIMENT

As seen in FIG. 1, a plastic tray according to the invention comprises a bottom 10, preferably of rectangular outline and side walls 11, which are formed integrally with the bottom 10 and are integral with each other at corners of the tray. The plastic of side walls 11, is continued through outer legs 12 to provide a circumferential member about the tray having the shape of an inverted V in cross-section.

On wrapping a filled tray of this design, the strains applied by tension of the wrapping film act to compress the inverted V instead of being applied as a compressive force acting against the edge of the side wall 11 with consequent risk of damage to integrity of the tray. Breakage of the side wall 11 permits juices of contained food such as meat to leak into the space between film and tray bottom resulting in an unsightly package and possible leakage of such juices through layers of film to soil paper bags, refrigerators used for storage and the like.

In order to promote nestability and easy denesting, the angle between inner surface of the circumferential member is greater than the angle between outer surfaces, as will be seen best in FIG. 3. In a typical embodiment the principle plane of the outer surfaces is at an angle of 32° to the vertical. With respect to the side wall 11, the principal plane of the under surface is at an angle of 58° to the horizontal, complementary to the 32° angle of the upper surface. The principal plane of the under surface of outer leg 12 is at 55° to the horizontal, resulting in the taper shown. This result is achieved by thermoforming a thermoplastic material between dies which provide a greater space between mold surfaces at the apex of the inverted V than at the end of the side wall 12.

As a result of this configuration, the upper surface of the circumferential member of one tray in a stack makes little more than line contact with the under surface of corresponding circumferential member of next higher tray. It follows that nesting of the trays in a stack is not impeded by extended sliding contact between adjacent surfaces of side walls 11 and outer legs 12 of superposed trays.

The reduced thickness of outer leg 12 at its base near the plane of bottom 10 is not a point of weakness in the present structure. The strains otherwise imposed on this thin section are absorbed obsorbed by flexure of the outer legs 12 during filling and sealing of the package.

The trays herein described are advantageously manufactured by thermoforming on automatic machinery of any suitable plastic and are preferably so formed of foamed polystyrene. Although the specific embodiment illustrated shows taper only of the outer leg 12, it will be readily apparent that the objects of the invention are also attainable by taper of the side wall 11 or by taper of both side wall 11 and outer leg 12.

I claim:

1. In a thermoformed tray of foamed thermoplastic resin for packing meat and the like having a rectangular planar bottom and side walls integral with said bottom and with each other extending upwardly and outwardly from the margin of said bottom; the improvement which comprises flanges integral with the upper margins of said side walls, which flanges extend outwardly and downwardly from said margin of said side walls and terminate at a level substantially in the plane of said bottom to provide a circumferential member about said tray having the cross-section form of an inverted V; said circumferential member being of greatest thickness of the region of junction of said side wall and said flange, at least one of said side wall and said flange being tapered to a lesser thickness away from said junction, whereby the angle between inner surfaces of said circumferential member is greater than the angle between outer surfaces thereof to provide essentially line contact between circumferential members of trays in a stack.

2. A tray according to claim 1 formed of foamed polystyrene.

* * * * *

UNITED STATES PATENT AND TRADEMARK OFFICE

CERTIFICATE OF CORRECTION

PATENT NO. : 3,997,101
DATED : December 14, 1976
INVENTOR(S) : JOHN FLORIAN

It is certified that error appears in the above-identified patent and that said Letters Patent are hereby corrected as shown below:

Column 1, line 10 "of" should be --or--.

Column 1, line 11 "contacts" should be --contracts--.

Column 1, line 16 "started" should be --stated--.

Column 2, line 59 "transporation" should be --transportation--.

Column 3, line 28 "surface" should be --surfaces--.

Column 4, line 10 "absorbed obsorbed" should be --primarily absorbed--.

Col. 4, line 34 (Claim 1) "of the region" should be --at the region--.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*